US010780730B2

(12) United States Patent
Wintermantel et al.

(10) Patent No.: US 10,780,730 B2
(45) Date of Patent: Sep. 22, 2020

(54) HANDHELD IMPLEMENT IN PARTICULAR WRITING INSTRUMENT

(71) Applicant: Schneider Schreibgerate GmbH, Schramberg (DE)

(72) Inventors: Patrick Wintermantel, Schramberg-Tennenbronn (DE); Klaus Kopp, Villingen-Schwenningen/Rietheim (DE)

(73) Assignee: Schneider Schreibgeräte GmbH, Schramberg (DE)

( * ) Notice: Subject to any disclaimer, the term of this patent is extended or adjusted under 35 U.S.C. 154(b) by 0 days.

(21) Appl. No.: 16/081,199

(22) PCT Filed: Feb. 21, 2017

(86) PCT No.: PCT/EP2017/000243
§ 371 (c)(1),
(2) Date: Aug. 30, 2018

(87) PCT Pub. No.: WO2017/148574
PCT Pub. Date: Sep. 8, 2017

(65) Prior Publication Data

US 2019/0092086 A1 Mar. 28, 2019

(30) Foreign Application Priority Data

Mar. 1, 2016 (DE) ..... 10 2016 002 439

(51) Int. Cl.
*B43K 27/02* (2006.01)
*B43K 29/05* (2006.01)
(Continued)

(52) U.S. Cl.
CPC ..... *B43K 29/05* (2013.01); *B43K 8/003* (2013.01); *B43K 23/06* (2013.01); *B43K 27/003* (2013.01);
(Continued)

(58) Field of Classification Search
CPC ..... B43K 29/05; B43K 8/003; B43K 23/06; B43K 27/003; B43K 27/006; B43K 27/04; B43K 27/08; B43K 27/12; B43L 19/0075
(Continued)

(56) References Cited

U.S. PATENT DOCUMENTS 2,457,217 A 12/1948 Ernst
4,228,028 A 10/1980 Lin
(Continued)

FOREIGN PATENT DOCUMENTS

DE 433810 9/1926
DE 8317634 11/1983
(Continued)

*Primary Examiner* — Jennifer C Chiang
(74) *Attorney, Agent, or Firm* — Volpe and Koenig, P.C.

(57) ABSTRACT

A handheld implement having a shaft with two shaft parts which are releasably connectable together via a plug-in coupling, with a coupling unit at each front end of the shaft parts. Each coupling unit has a slide held in a guide hole open on a face side in the associated shaft part and protrudes beyond the guide hole with a slide portion, the free end of which is formed as a latching fork that has a latching opening. The slide portion bears a latching protrusion behind the latching fork in the sliding direction. The coupling unit has a guide sleeve that encloses the slide and is guided into the guide hole counter to a restoring force, and when the front ends, having the coupling units, of the shaft parts are pressed together, the latching fork of one coupling unit is latchable on the latching protrusion of the other coupling unit.

12 Claims, 6 Drawing Sheets

(51) Int. Cl.

| | |
|---|---|
| ***B43K 8/00*** | (2006.01) |
| ***B43K 23/06*** | (2006.01) |
| ***B43K 27/00*** | (2006.01) |
| ***B43K 27/04*** | (2006.01) |
| ***B43K 27/08*** | (2006.01) |
| ***B43L 19/00*** | (2006.01) |
| *B43K 23/12* | (2006.01) |

(52) U.S. Cl.
CPC ..... *B43K 27/006* (2013.01); *B43K 27/04* (2013.01); *B43K 27/08* (2013.01); *B43L 19/0075* (2013.01); *B43K 23/12* (2013.01)

(58) Field of Classification Search
USPC ..... 401/17–19
See application file for complete search history.

(56) References Cited

U.S. PATENT DOCUMENTS

| | | | |
|---|---|---|---|
| 6,425,703 | B1 | 7/2002 | McDonnell et al. |
| 6,663,305 | B2 | 12/2003 | Poulos |
| 7,494,294 | B1 | 2/2009 | Kuo |
| 2003/0130663 | A1 | 7/2003 | Walen |
| 2008/0075528 | A1 | 3/2008 | Marzetta |
| 2013/0051896 | A1 | 2/2013 | Hung |

FOREIGN PATENT DOCUMENTS

| | | |
|---|---|---|
| DE | 10357104 | 7/2005 |
| DE | 202011052490 | 3/2012 |

HANDHELD IMPLEMENT IN PARTICULAR WRITING INSTRUMENT

BACKGROUND

The invention relates to a handheld implement having a shaft, that has at least two shaft parts, which are releasably connectable together via a plug-in coupling, that have a coupling unit at each front end of the shaft parts.

Handheld implements of the type mentioned at the beginning, which have a shaft that has at least two shaft parts, which are releasably connectable together via a plug-in coupling, are already known in various configurations. The plug-in couplings that are customary in the previously known implements are not always usable, however, in particular not in relatively small implements, for example, writing instruments.

Writing instruments that have differently usable nibs at their opposite free front ends are already known. In the case of an ink eraser, it is possible, for example, for one nib provided on the face side to be in the form of an erasing nib, with which ink is partially erasable again, while, in contrast, the other nib has a marker that is insoluble for the erasing nib and with which the originally erased text can be written over again.

SUMMARY

The object is in particular to create a handheld implement of the type mentioned at the beginning, in which the shaft parts, assigned for example to different functions, can be connected together easily and resiliently by a plug-in coupling, whereby the plug-in coupling is intended to be lightweight and space-saving even in the case of relatively small implements.

The invention achieves this object in the case of the handheld implement of the type mentioned at the beginning in particular in that each coupling unit of the shaft parts has a slide that is held immovably in a guide hole open on a face side in the associated shaft part and protrudes beyond the guide hole with a slide portion, in that the free end of the slide portion is in the form of a latching fork that has a latching opening between two fork arms, in that the slide portion bears a latching protrusion on its inner side behind the latching fork in the sliding direction, in that the coupling unit has a guide sleeve that encloses the slide and is guided movably in the guide hole counter to the restoring force of a spring- or rubber-elastic restoring element, and in that, when the front ends, having the coupling pieces, of two shaft parts are pressed together, the latching fork of one coupling part is latchable on the latching protrusion of the other coupling part with at least one of the guide sleeves being pushed back.

The handheld implement according to the invention has a shaft that has at least two shaft parts. In order for it to be possible to complete these shaft parts to form the shaft of the handheld implement, these shaft parts are releasably connectable together via a plug-in coupling that has a coupling unit at each front end of the shaft parts. The preferably structurally identical coupling units of the shaft parts each have a slide that is held immovably in a guide hole open on the face side in the associated shaft part. The slides of the coupling units protrude beyond the guide hole with a slide portion. In this case, the free end of the protruding slide portion is in the form of a latching fork that has a latching opening between two fork arms. On its inner side, behind the latching fork in the sliding direction, each slide bears a latching protrusion. The coupling units each have a guide sleeve that encloses the slide and is guided movably in the guide hole counter to the restoring force of a spring- or rubber-elastic restoring element. When the front ends, having the coupling units, of two shaft parts are pressed together, the latching fork of one coupling unit can be latched on the latching protrusion of the other coupling unit with at least one of the guide sleeves being pushed back. Since each coupling unit is latched together with the respectively other coupling part, the shaft parts are held firmly together by their coupling units. The firm hold of the shaft parts and the coupling units thereof is further favored in that the coupling units held together in each case are engaged around by the guide sleeves, of which at least one guide sleeve is pushed back only far enough for the coupling units to be able to latch together.

A particular advantage of the handheld implement according to the invention is that at least one of the shaft parts can have a non-round outer cross section at least regionally.

In this case, it is advantageous for the guide hole to have a round hole cross section.

In a preferred development of the invention, which is distinguished by a particularly firm hold of the latched-together coupling units, the slide portion bears, at least in its subregion having the latching fork and the latching protrusion, against the inner circumferential wall of the guide sleeve by way of an outer contour rounded in a complementary manner. In this case, the two slide portions of the latched-together coupling units of the plug-in coupling almost completely fill the clear sleeve cross section of the guide sleeves, bearing against one another, of the shaft parts.

In order to facilitate the latching together of the shaft parts that is brought about by the pressing together of the front ends, having the coupling units, of two shaft parts, it is advantageous when the slide has a sliding surface bearing the latching protrusion, said sliding surface being arranged approximately in the longitudinal center plane of the guide sleeve, and when, when the coupling units are connected, the sliding surfaces of the slides thereof slide along one another. These sliding surfaces provided on the slides, said sliding surfaces sliding along one another when the coupling units are connected, make it considerably easier to insert the coupling units one into the other.

The pushing of the slide portions engaged around by the guide sleeves onto one another is favored when the latching forks have a run-on slope or a run-on rounding in their internal end-edge regions adjoining the sliding surface.

The handling of the plug-in coupling is made even easier when a guide rib is provided behind the latching protrusion in the sliding direction, and when the latching forks engage with the latching protrusion of the respectively other coupling unit on both sides by way of their fork arms in the holding position of the plug-in coupling.

A smooth movement of the guide sleeve in the guide hole of the shaft part is favored and canting of the guide sleeve during pushing back is avoided when the guide sleeve and the slide of each coupling unit are guided movably relative to one another on one another.

In order that the guide sleeve of each coupling unit is always pushed forward such that the guide sleeve can enclose the protruding slide portion, it is advantageous when a compression spring is provided as a restoring element of each coupling unit, said compression spring being clamped in place between the guide sleeve guided movably on the slide, on one side, and a restoring-element anchor that is fastenable immovably in the shaft interior of the associated shaft part, on the other side.

In a preferred embodiment of the invention, the handheld implement is in the form of a writing-instrument unit, and the shaft parts that are releasably connectable together each bear a nib at their front ends remote from the coupling unit. In this case, one nib can be for example in the form of an ink eraser, while the other nib is usable with a writing ink that is insoluble with respect to the ink eraser. In another embodiment according to the invention, the nibs of the shaft parts exhibit different colors or color combinations. It also possible, however, to configure the nib of one shaft part as a fiber-tip pen, while the nibs of other shaft parts are provided as coloring tips, and additionally or instead, it is possible for the nib of at least one shaft part to have a smaller or larger line width compared with the nibs of other shaft parts.

In a preferred development of the invention, the nibs of the shaft parts that are releasably connectable together differ from one another by way of the writing color, the nib, the shape thereof or the size thereof that determines the line width, the type of writing instrument or any combination of at least two of these features.

As has already been mentioned above, however, it is also possible for, of the shaft parts that are releasably connectable together, one shaft part to bear a nib in the form of an ink eraser, while, in contrast, the nib of the other shaft part has a writing color that is resistant to the ink eraser.

BRIEF DESCRIPTION OF THE DRAWINGS

Developments of the invention are apparent from the drawing in conjunction with the description and the claims. In the following text, the invention is described in more detail on the basis of a preferred exemplary embodiment.

In the drawing.

DETAILED DESCRIPTION

Figures 1, 2:
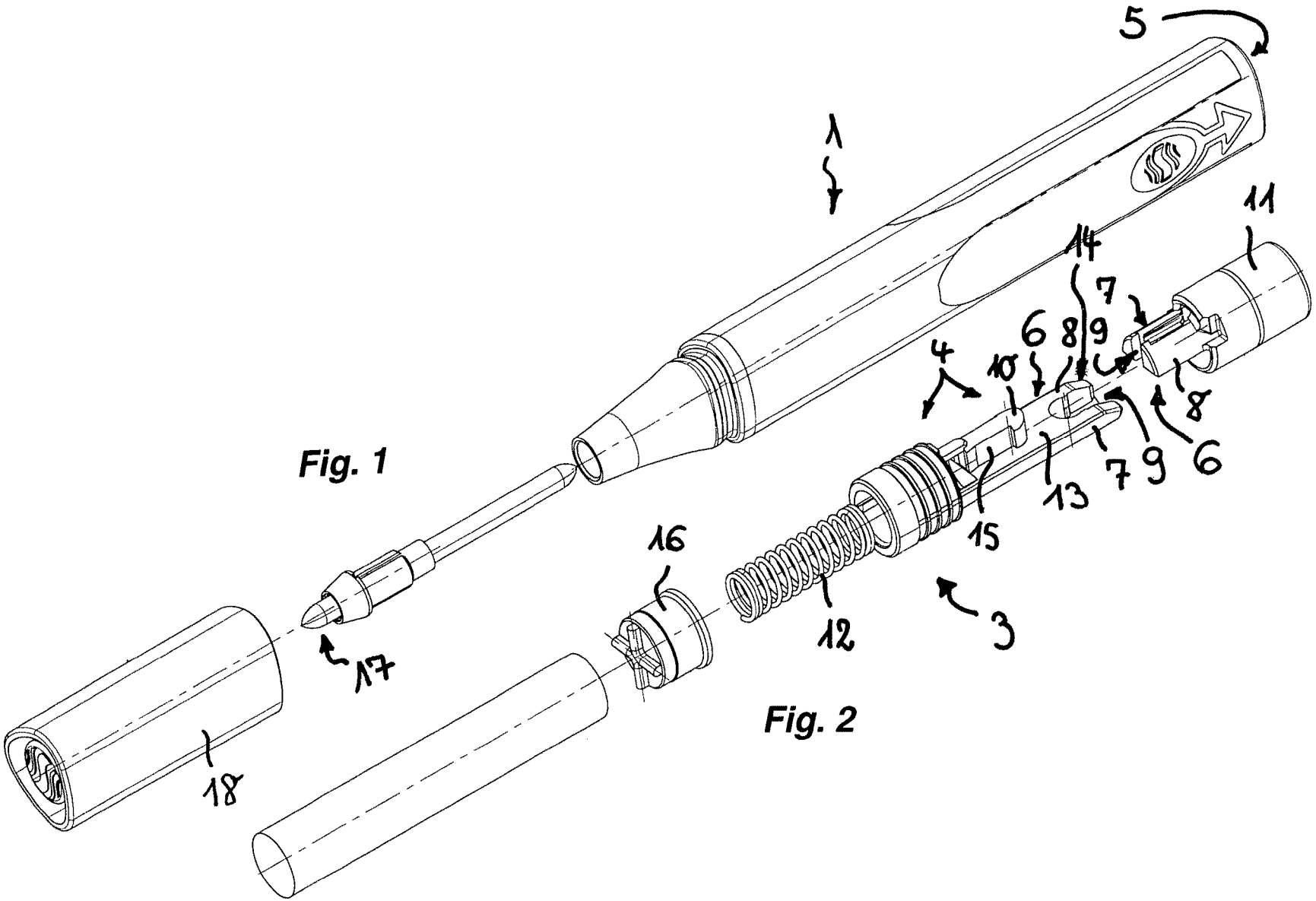
FIG. 1 shows a shaft part, in the form of a writing instrument here, of a handheld implement, which shaft part has, at one of its front ends, a coupling unit of a plug-in coupling, with which coupling unit the shaft part can be connected releasably to the coupling unit of a further shaft part and be completed to form the shaft of the handheld implement, of a writing-instrument unit here.
FIG. 2 shows the coupling unit, having a restoring-element anchor, a spring-elastic restoring element, a slide and a guide sleeve, of the writing instrument shown in FIG. 1, whereby the slide of the coupling unit of a coupling unit able to be coupled thereto is additionally also illustrated.
Figure 3:
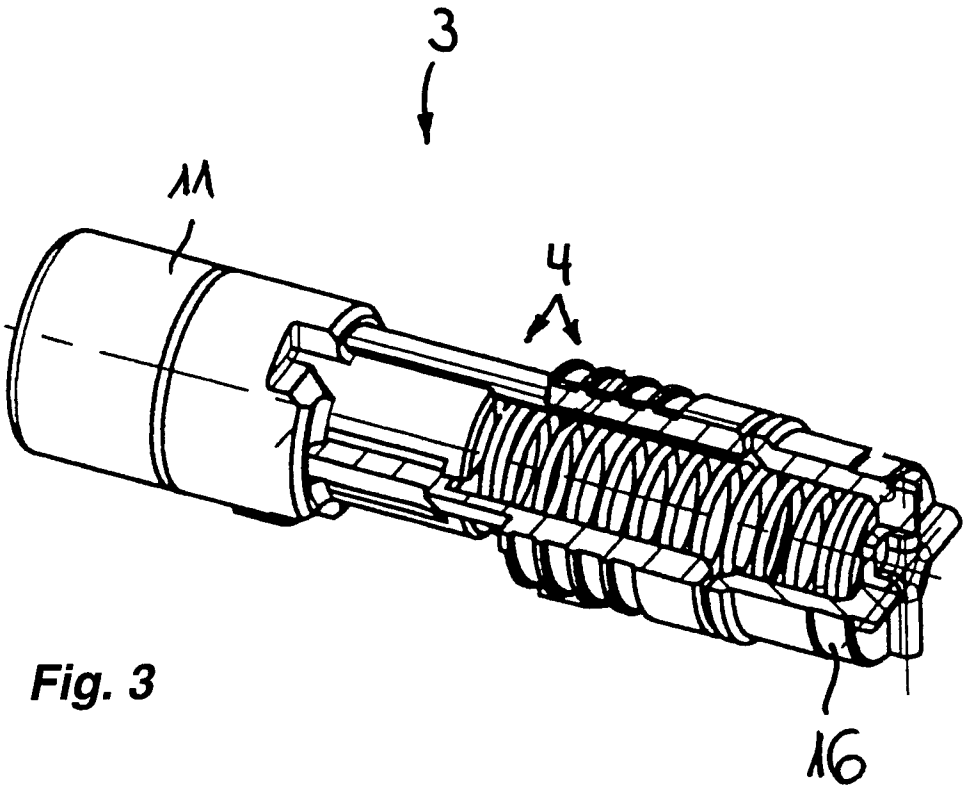
FIG. 3 shows the coupling unit from FIG. 2 in a configuration illustrated partially in longitudinal section.
Figure 10:
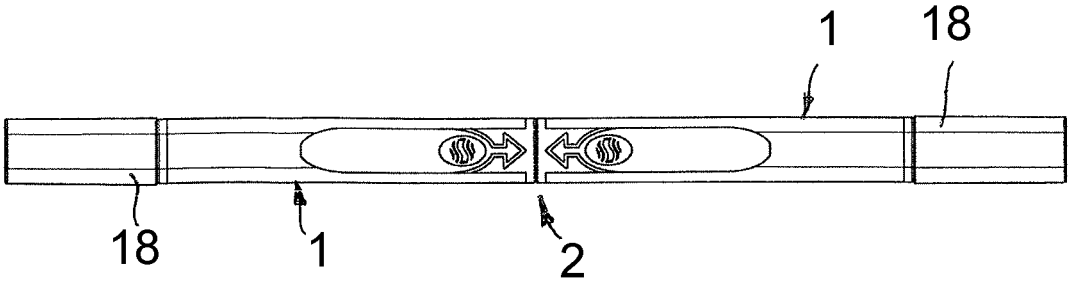
FIG. 10 shows a completed handheld implement formed of two of the shaft parts as shown in FIG. 1 that are releasably connected via identical coupling units to form the shaft of the handheld implement.

FIG. 1 illustrates a shaft part 1 of a handheld implement. This shaft part 1 is releasably connectable to a further shaft part 1 and intended to be completed to form the shaft of the handheld implement, shown in FIG. 10. The shaft parts 1 of the handheld implement are releasably connectable together via a plug-in coupling 2. To this end, the plug-in coupling 2 has two preferably structurally identical coupling units 3 that are releasably connectable together and are each provided on one of the front ends of the shaft parts 1.

Figure 4:
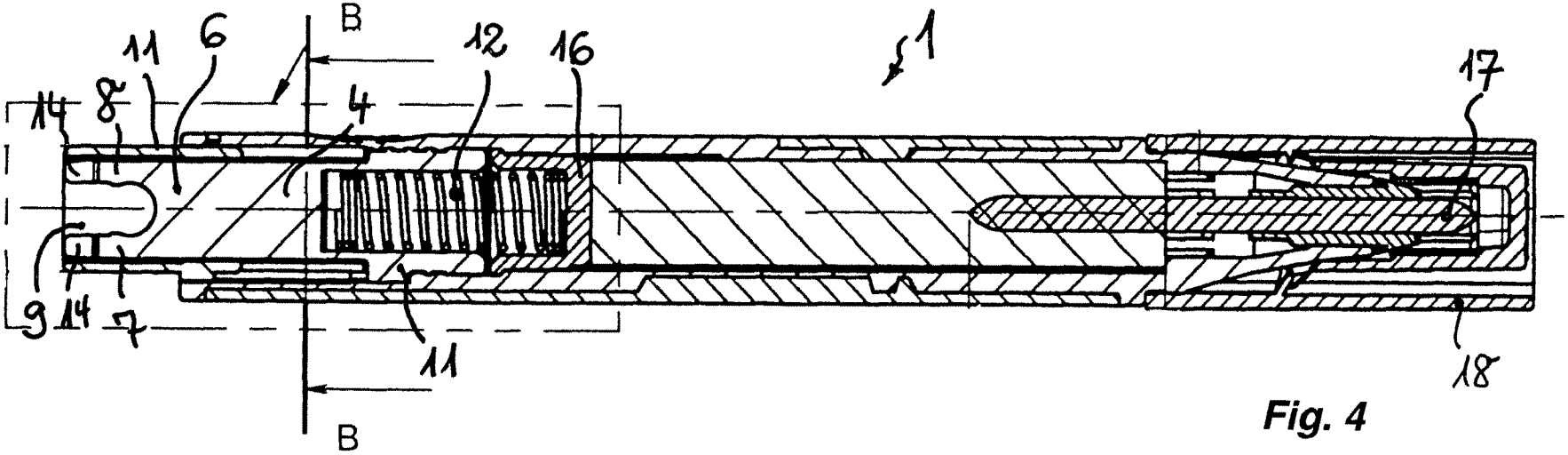
FIG. 4 shows the writing instrument from FIG. 1 in a longitudinal section.

Each coupling unit 3 has in each case one slide 4, which is held immovably in a guide hole 5 open on a face side in the associated shaft part 1. It is apparent from FIG. 4 that the slide 4 protrudes beyond the guide hole 5 of the associated shaft part 1 with a slide portion 6. In this case, the free end of the slide portion 6 is in the form of a latching fork, which has a latching opening 9 between two fork arms 7, 8. On the inner side of the slide portion 6, a latching protrusion 10 is provided behind the latching fork in the sliding direction. The coupling units 3 provided on the shaft parts 1 each also have a guide sleeve 11, which encloses the protruding slide portion 6 and is guided movably counter to the restoring force of a rubber-elastic—or as here—spring-elastic restoring element 12 in the guide hole 5.

When the front ends, having the coupling units 3, of two shaft parts 1 are pressed together, the latching fork of the one, first coupling unit 3 is able to be latched together with the latching protrusion 10 of the other, second coupling unit 3 with at least one guide sleeve 11 being pushed back, whereby, at the same time, the latching fork of the second coupling unit 3 latches together with the latching fork of the first coupling unit. The latching forks and latching protrusions 10, latched together in such a way, of the plug-in coupling 2 are in this case engaged around in a protective manner by the guide sleeves 11, which circumferentially surround the component parts of the plug-in coupling 2 preferably completely. Since the latching elements of two shaft parts 1 are able to be latched together when the coupling units 3 thereof are pressed together with at least one guide sleeve 11 being pushed back, and since the guide sleeves 11 otherwise engage around these latching elements 6 and 10, respectively, in a protective manner, the risk to the user of the handheld implement of unintentional injuries on account of protruding contoured or even pointed component parts of the coupling units 3 is avoided or at least substantially reduced.

Figure 5:
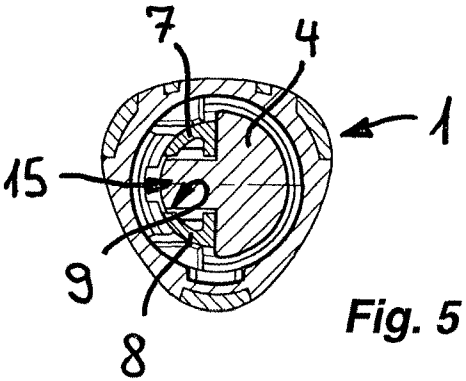
FIG. 5 shows the writing instrument from FIGS. 1 and 4 in a cross section through the section plane B-B in FIG. 4.
Figure 6:
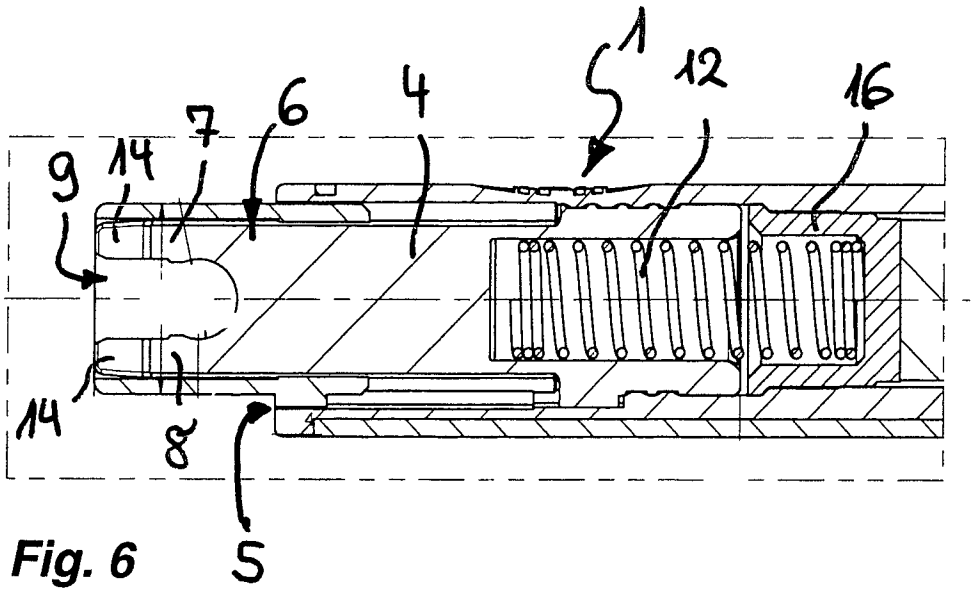
FIG. 6 shows the writing instrument from FIGS. 1, 4 and 5 in a detail longitudinal section in the subregion that shows the coupling unit and is bordered by a dashed line in the figure.
Figures 7, 8, 9:
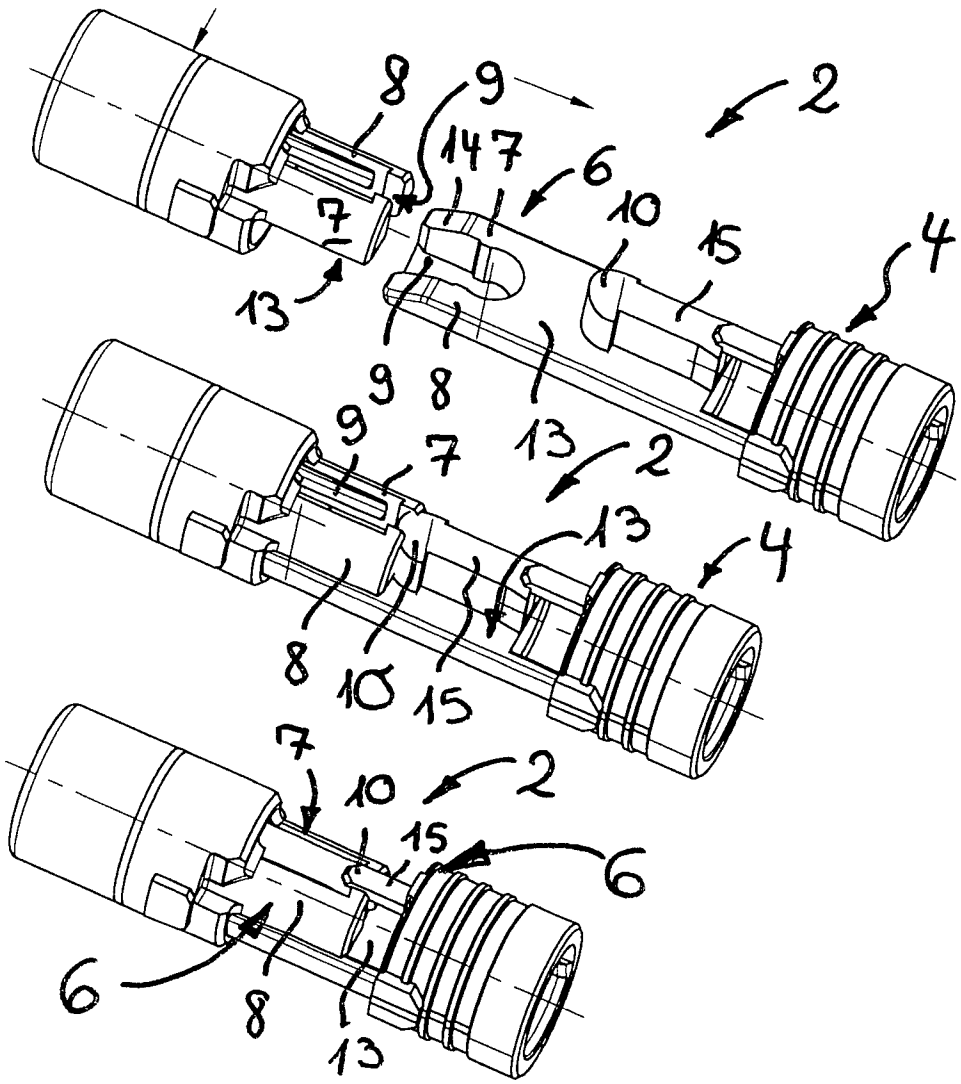
FIG. 7 shows the coupling unit of the writing instrument shown in FIG. 1 immediately before it is connected to the coupling unit of another writing instrument.
FIG. 8 shows the coupling unit according to FIG. 7 while it is being connected to the coupling unit of another writing instrument.
FIG. 9 shows the coupling unit shown in FIGS. 7 and 8, which is releasably connected here to the coupling unit of another writing instrument.

The guide holes 5 provided in the shaft parts 2 have a round hole cross section. Independently thereof, the shaft parts 1 themselves can have a round or even a non-round outer cross section at least regionally. It is clear from the cross-sectional illustration in FIG. 5 that the shaft parts 1 in this case have for example a substantially triangular outer cross section. It is also apparent from the cross section in FIG. 5 that the slide portion 6 protruding beyond the shaft part 1 bears, at least in its subregion having the latching fork and the latching protrusion 10, against the inner circumferential wall of the guide sleeve 11 by way of an outer contour rounded in a complementary manner. In this case, the slide portions 6, bearing against the flat sides of one another, of the connected-together shaft parts 1 complete one another to form a substantially cylindrical outer contour.

Each slide 4 has a sliding surface 13 bearing the latching protrusion 10, said sliding surface 13 being arranged approximately in the longitudinal center plane of the guide sleeve 11. Thus, when the coupling units 3 are being connected, the sliding surfaces 13 of the slides 4 thereof slide along one another.

In the internal end-edge region, adjoining the sliding surface 13, of the free arm ends of their fork arms 7, 8, the latching forks of the slides 4 each have a run-on slope or a run-on rounding 14. As a result of this run-on rounding, the fork arms 7, 8 of the coupling units 3 to be connected together can slide readily along one another.

Provided behind the latching protrusion 10, in the sliding direction, of each slide 4 is a guide rib 15. The latching protrusion 10 and the guide rib 15 located there-behind have an arrow shaped outer contour in plan view. The latching forks engage with the latching protrusion 10 of the respectively other coupling unit 3 on both sides by way of their fork arms 7, 8 in the holding position of the plug-in coupling 2.

The guide sleeve 11 and the slide 4 of each coupling unit 3 are guided in a movable manner relative to one another on one another. The restoring element 12, acting on each guide sleeve 11, of each coupling unit 3 is configured here as a compression spring, which is clamped in place between the guide sleeve 11 guided movably on the slide 4, on one side, and a restoring-element anchor 16 that is fastenable immovably in the shaft interior of the associated shaft part 1, on the other side.

It is clear from viewing FIGS. 1 to 9 together that the handheld implement is configured here for example as a writing-instrument unit and that the shaft parts 1 that are releasably connectable together and are each in the form of a writing instrument each bear a nib 17 at their front ends remote from the coupling unit 3. These nibs 17 can be protected by a writing-instrument cap 18, which can also be plugged onto the guide sleeve 11 of the associated coupling unit 3 and kept safe while the writing instrument is being used. In order that the writing-instrument cap 18 can be plugged onto the guide sleeve 11 without the guide sleeve 11 receding into the shaft interior of the shaft part 1, the restoring force of the restoring element 12 is calculated such that the guide sleeve 11 remains in its position protruding beyond the guide hole 5 when the writing-instrument cap 18 is merely plugged on.

The nibs of the shaft parts 1 that are releasably connectable together can differ from one another for example by way of the writing color, the nib, the shape thereof or the size thereof that determines the line width, the type of writing instrument or any combination of these features. In another exemplary embodiment of the invention, of the shaft parts 1 that are releasably connectable together, one shaft part 1 bears a nib in the form of an ink eraser, while, in contrast, the nib of the other shaft part has a writing color that is insoluble with respect to the ink eraser. However, it is also possible to configure the nib of one shaft part 1 as a fiber-tip pen, while the nibs of other shaft parts are provided as coloring tips, and additionally or instead, the nib of at least one shaft part 1 can have a smaller or larger line width compared with the nibs of other shaft parts 1.

The use of the handheld implement according to the invention is not limited to a writing-instrument unit. However, rather the handheld implement can also be a completely different implement in which the at least two shaft parts of the shaft are intended to be connected releasably together, whereby the plug-in coupling provided between the shaft parts is intended to be producible with little effort, to be space-saving and resilient.

LIST OF REFERENCE SIGNS

1 Shaft part
2 Plug-in coupling
3 Coupling unit
4 Slide
5 Guide hole
6 Slide portion
7 Fork arm
8 Fork arm
9 Latching opening
10 Latching protrusion
11 Guide sleeve
12 Restoring element
13 Sliding surface
14 Run-on rounding
15 Guide rib
16 Restoring-element anchor
17 Nib
18 Writing-instrument cap

The invention claimed is:

1. A handheld implement comprising:

a shaft that has at least two shaft parts (1) that are releasably connectable together via a plug-in coupling (2) that has a coupling unit (3) at each front end of the shaft parts (1), each coupling unit (3) of the shaft parts (1) comprises:

a slide (4) that is held immovably in a guide hole (5) open on a face side in an associated one of the shaft parts (1) and protrudes beyond the guide hole (5) with a slide portion (6), the slide portion (6) including a free end formed as a latching fork that has a latching opening (9) between two fork arms (7, 8), the slide portion (6) bears a latching protrusion (10) on an inner side thereof behind the latching fork in a sliding direction, a guide sleeve (11) that encloses the slide (4) and is guided movably in the guide hole (5) counter to the restoring force of a spring-or rubber-elastic restoring element (12), and wherein, when the front ends, having the coupling units (3), of two shaft parts (1) are pressed together, the latching fork of one of the coupling units (3) is latchable on the latching protrusion (10) of the other of the coupling units (3) with at least one of the guide sleeves (11) being pushed back.

2. The handheld implement as claimed in claim 1, wherein at least one of the shaft parts (1) has a non-round outer cross section at least regionally.

3. The handheld implement as claimed in claim 1, wherein the guide hole (5) has a round hole cross section.

4. The handheld implement as claimed in claim 1, wherein the slide portion (6) bears, at least in a subregion having the latching fork and the latching protrusion (10), against an inner circumferential wall of the guide sleeve (11) by way of an outer contour rounded in a complementary manner.

5. The handheld implement as claimed in claim 1, wherein the slide (4) has a sliding surface (13) bearing the latching protrusion (10), said sliding surface (13) being arranged approximately in a longitudinal center plane of the guide sleeve (11), and, when the coupling units (3) are connected, the sliding surfaces (13) of the slides (4) thereof slide along one another.

6. The handheld implement as claimed in claim 1, wherein the latching forks each have a run-on slope or a run-on rounding (14) at internal end-edge regions adjoining the respective sliding surface (13).

7. The handheld implement as claimed in claim 1, further comprising a guide rib (15) behind the latching protrusion (10) in the sliding direction, and the latching forks engage with the latching protrusion (10) of the respectively other one of the coupling units on both sides by the fork arms (7, 8) thereof in a holding position of the plug-in coupling (2).

8. The handheld implement as claimed in claim 1, wherein the guide sleeve (11) and the slide (4) of each of the coupling units (3) are guided movably relative to one another.

9. The handheld implement as claimed in claim 1, further comprising a compression spring that forms the restoring element (12) of each said coupling piece (3), said compression spring being clamped in place between the guide sleeve (11) guided movably on the slide (4), on one side, and a restoring-element anchor (16) that is fastenable immovably in an interior of the associated shaft part (1), on the other side.

10. The handheld implement as claimed in claim 1, wherein the handheld implement is a writing instrument, and the shaft parts (1) that are releasably connectable together each bear a nib (17) at the front ends thereof remote from the coupling piece (3).

11. The handheld implement as claimed in claim 10, wherein the nibs (17) of the shaft parts (1) that are releasably connectable together differ from one another by at least one of a writing color, the nib, a shape thereof or a size thereof that determines a line width, or a type of writing instrument.

12. The handheld implement as claimed in claim 1, wherein, of the shaft parts (1) that are releasably connectable together, one of the shaft parts (1) bears a nib (17) formed as an ink eraser, and the nib (17) of the other shaft part (1) has a writing ink that is resistant to the ink eraser.

* * * * *